US011326408B2

(12) United States Patent
Clemens et al.

(10) Patent No.: US 11,326,408 B2
(45) Date of Patent: May 10, 2022

(54) FLEXIBLE SMART RELEASE TOOL

(71) Applicant: Halliburton Energy Services, Inc., Houston, TX (US)

(72) Inventors: Jack Gammill Clemens, Fairview, TX (US); Bryan William Kasperski, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 362 days.

(21) Appl. No.: 15/328,390

(22) PCT Filed: Aug. 22, 2014

(86) PCT No.: PCT/US2014/052327
§ 371 (c)(1),
(2) Date: Jan. 23, 2017

(87) PCT Pub. No.: WO2016/028318
PCT Pub. Date: Feb. 25, 2016

(65) Prior Publication Data

US 2017/0226814 A1 Aug. 10, 2017

(51) Int. Cl.
*E21B 23/00* (2006.01)
*E21B 17/06* (2006.01)
(Continued)

(52) U.S. Cl.
CPC ..... *E21B 23/00* (2013.01); *E21B 17/06* (2013.01); *E21B 41/0092* (2013.01); *E21B 47/12* (2013.01)

(58) Field of Classification Search
CPC ..... E21B 23/00; E21B 17/06; E21B 17/023; E21B 41/0092; E21B 47/12
See application file for complete search history.

(56) References Cited

U.S. PATENT DOCUMENTS 6,269,883 B1 * 8/2001 Gissler ..... E21B 17/023 166/241.5
6,333,700 B1 12/2001 Thomeer et al.
(Continued)

FOREIGN PATENT DOCUMENTS

CN 1599834 3/2005
WO 2014-05561 4/2014

OTHER PUBLICATIONS

International Search Report and Written Opinion, Application No. PCT/US2014/052327; 16 pgs, dated May 19, 2015.
(Continued)

*Primary Examiner* — Christopher J Sebesta
(74) *Attorney, Agent, or Firm* — John Wustenberg; Baker Botts L.L.P.

(57) ABSTRACT

A flexible smart release tool enables a control unit at the surface to individually communicate with release tools that are located downhole. The release tools may be individually addressed using a unique logical identifier. Thus, a specific release tool may be sent a command to release an attached downhole tool string at any time. The release tool may include control logic for receiving the command and using an onboard clock for timing of activation of a release interface, as optionally specified in the command. A heartbeat function may be implemented between the release tool and the control unit.

16 Claims, 3 Drawing Sheets

(51) Int. Cl.
*E21B 41/00* (2006.01)
*E21B 47/12* (2012.01)

(56) References Cited

U.S. PATENT DOCUMENTS

| | | | | |
|---|---|---|---|---|
| 6,915,848 | B2 | 7/2005 | Thomeer et al. | |
| 6,926,088 | B2 | 8/2005 | Tucker | |
| 6,938,689 | B2 | 9/2005 | Farrant et al. | |
| 7,195,083 | B2 | 3/2007 | Eppink et al. | |
| 7,257,050 | B2 | 8/2007 | Stewart et al. | |
| 8,485,265 | B2 | 7/2013 | Marya et al. | |
| 8,499,826 | B2 | 8/2013 | Hillis et al. | |
| 8,540,021 | B2 | 9/2013 | McCarter et al. | |
| 2003/0102132 | A1* | 6/2003 | Estep | E21B 17/06 166/377 |
| 2004/0217880 | A1 | 11/2004 | Clark et al. | |
| 2005/0045331 | A1* | 3/2005 | Lerche | E21B 41/00 166/297 |
| 2007/0023191 | A1* | 2/2007 | Dreggevik | E21B 17/023 166/377 |
| 2009/0151940 | A1* | 6/2009 | Malone | E21B 47/09 166/255.1 |
| 2010/0319930 | A1* | 12/2010 | Evans | E21B 17/023 166/377 |
| 2013/0008668 | A1 | 1/2013 | Tinker et al. | |
| 2013/0014934 | A1 | 1/2013 | Macrae et al. | |
| 2013/0024030 | A1 | 1/2013 | Tubel et al. | |
| 2013/0168083 | A1* | 7/2013 | McCarter | E21B 23/00 166/250.01 |
| 2013/0206402 | A1 | 8/2013 | Coon et al. | |
| 2013/0213645 | A1* | 8/2013 | Proett | E21B 49/10 166/250.17 |
| 2015/0019901 | A1* | 1/2015 | Griffith | G06F 11/2002 714/4.11 |
| 2015/0129204 | A1* | 5/2015 | Smith | E21B 17/06 166/250.01 |

OTHER PUBLICATIONS

International Preliminary Report on Patentability received for PCT Patent Application No. PCT/US2014/052327, dated Mar. 9, 2017; 13 pages.

Snider, Philip Martin, "RFID Actuation of Self-Powered Downhole Tools," SPE/ICoTA Coiled Tubing and Well Intervention Conference and Exhibition, Apr. 1-2, The Woodlands, Texas, USA, https://www.onepetro.org/conference-paper/SPE-113842-MS; 6 pages, Apr. 2, 2008.

"Addressable Downhole Release (ADR) and Panel (ADRP)," GE Oil & Gas, http://www.ge-energy.com/products_and_services/products/wireline_systems/addressable_downhole_release_and_panel.jsp, 3 pages, Sep. 17, 2014.

Clemens, Jack et al., "New Slickline Smart Release Tool Mitigates Wire Recovery Issues in Extreme Well Conditions," SPE Annual Technical Conference and Exhibition, Oct. 4-7, New Orleans, Louisiana, https://www.onepetro.org/conference-paper/SPE-124966-MS; 10 pages, Oct. 7, 2009.

"Mechanical Tubing Release," Magnum Oil Tools International, 6 pages, 2013.

* cited by examiner

FLEXIBLE SMART RELEASE TOOL

RELATED APPLICATIONS

This application is a U.S. National Stage Application of International Application No. PCT/US2014/052327 filed Aug. 22, 2014, which designates the United States, and which is incorporated herein by reference in its entirety.

TECHNICAL FIELD

This disclosure relates generally to subterranean drilling equipment and, more particularly, to a flexible smart release tool.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a borehole at a desired well site, treating the borehole to optimize production of hydrocarbons, and performing the necessary steps to produce and process the hydrocarbons from the subterranean formation.

Downhole tools are used within a wellbore to assist with the production of hydrocarbons from a subterranean formation. Some common downhole tools are frac plugs, bridge plugs, and packers, which are used to seal a component against casing along the wellbore wall or to isolate one pressure zone of the formation from another.

During subterranean operations, the downhole tools and other equipment may be raised, lowered or released within the wellbore. For example, a downhole tool can be conveyed into the wellbore on a wireline, tubing, pipe, or another type of conveyance. In conventional systems, the operator estimates the location of the downhole tool based on this mechanical connection and, in some cases, also communicates with the downhole tool through this electro-mechanical connection.

In certain instances, downhole tools are equipped with a release tool to release the downhole tool from the drill string. Some release tools are activated by mechanical mechanisms, such as activation via a wire, which may not be effective in complex or deep wells. Techniques are known for activating a release tool for releasing a downhole tool using timer-based logic that activates after a predetermined release delay. The predetermined release delay is set prior to introduction of the release tool in the wellbore.

FIGURES

Some specific exemplary embodiments of the disclosure may be understood by referring, in part, to the following description and the accompanying drawings.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and are not exhaustive of the scope of the disclosure.

DESCRIPTION OF PARTICULAR EMBODIMENT(S)

The present disclosure relates generally to well drilling equipment and, more particularly, to a flexible smart release tool.

To facilitate a better understanding of the present disclosure, the following examples are presented for descriptive purposes. In no way should the following examples be read to limit, or define, the scope of the disclosure. Embodiments of the present disclosure may be applicable to horizontal, vertical, deviated, multilateral, u-tube connection, intersection, bypass (drill around a mid-depth stuck fish and back into the well below), or otherwise nonlinear boreholes in any type of subterranean formation. Embodiments may be applicable to injection wells as well as production wells, including natural resource production wells such as hydrogen sulfide, hydrocarbons or geothermal wells. Devices and methods in accordance with embodiments described herein may be used in one or more of wire line, slick line, measurement while drilling (MWD) and logging while drilling (LWD) operations. Embodiments described below with respect to one implementation, such as wire line, are not intended to be limiting. Embodiments may be implemented in various formation tools suitable for measuring, data acquisition and/or recording data along sections of the formation that, for example, may be conveyed through flow passage in tubular string or using a wire line, slick line, tractor, piston, piston-tractor, coiled tubing, downhole robot or the like.

Figure 1:
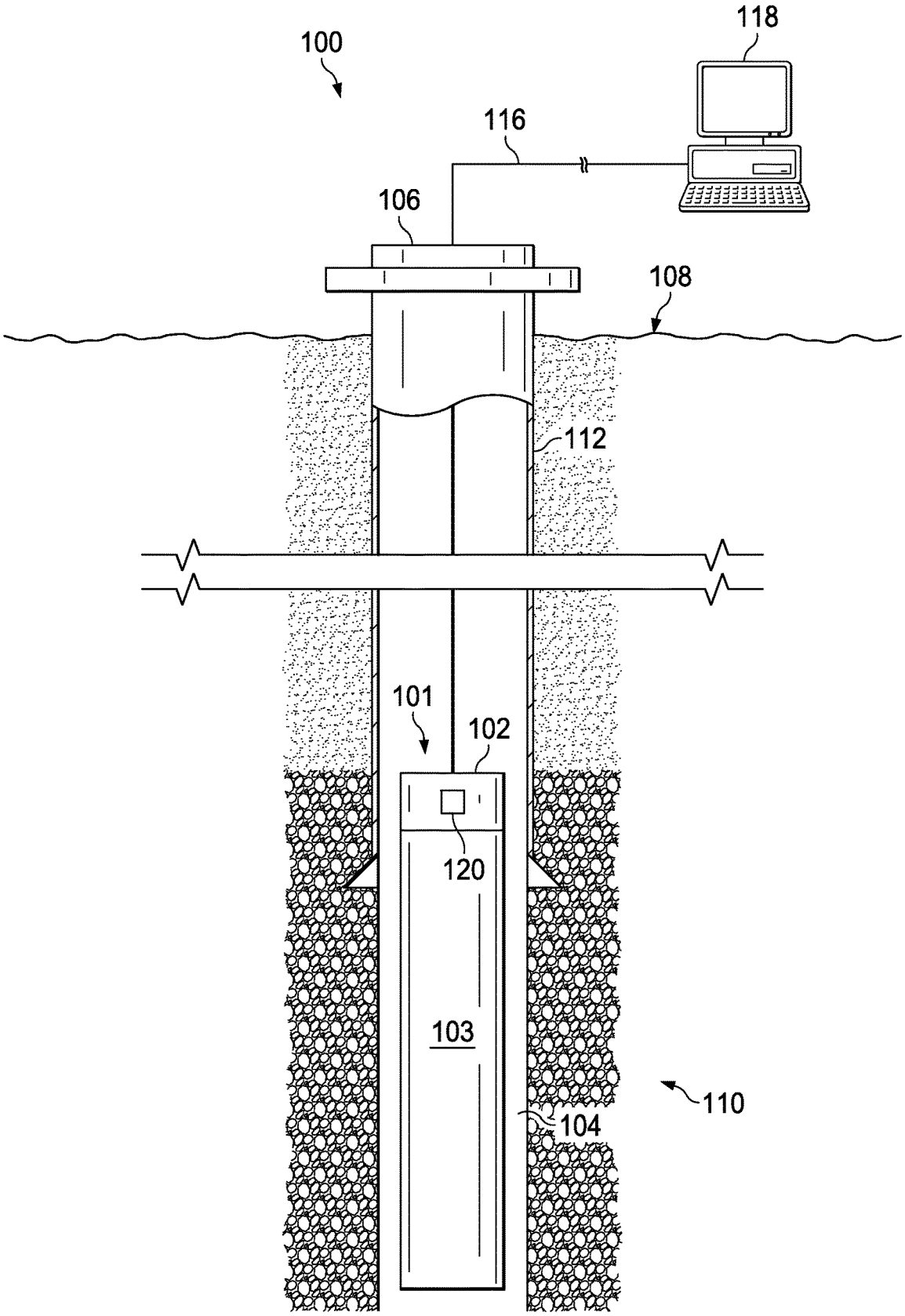
FIG. 1 is a block diagram of an example well system using a flexible smart release tool, in accordance with some embodiments of the present disclosure.

Referring now to the drawings, in which FIG. 1 is a cross-sectional view of a well system 100 with downhole assembly 101 including release tool 102 (also referred to as a "smart release tool") and downhole tool string 103. FIG. 1 is a schematic representation of selected elements of an embodiment of well system 100 and is not drawn to scale. It will be understood that the present disclosure is applicable to different embodiments of well systems. As shown, well system 100 includes release tool 102 within a substantially cylindrical wellbore 104 that extends from well head 106 at surface 108 through one or more subterranean zones 110 that may be of interest to an owning entity or to an operating entity associated with well system 100.

In FIG. 1, wellbore 104 is depicted extending substantially vertically from surface 108. However, in different embodiments, wellbore 104 may follow another path, for example, by deviating to horizontal in at least a portion of subterranean zone 110. In various sections, which are omitted from FIG. 1 for descriptive clarity, wellbore 104 may be slanted or may include other deviations from horizontal and vertical paths. At least a portion of wellbore 104 may be lined with casing 112, constructed of successive lengths of tubing, that extends downhole from well head 106. Casing 112 may provide radial support to wellbore 104 and may seal against unwanted communication of fluids between wellbore 104 and the surrounding formations. As shown, casing 112 terminates near the start of subterranean zone 110 and the remainder of the wellbore 104 in the downhole direction is an open hole, e.g., uncased. In other instances, the casing 112 may extend to different positions within wellbore 104.

As illustrated in FIG. 1, downhole assembly 101 is coupled to conveyance 116 such as a wireline, a slickline, an electric line, a coiled tubing, straight tubing, or the like. Downhole assembly 101 may include release tool 102 and downhole tool string 103. Release tool 102 may raise, lower, or release downhole tool string 103 within the wellbore 104. In some instances, downhole tool string 103 may be lowered by release tool 102 using conveyance 116 from surface 108 and then released to descend down wellbore 104 or to remain at a particular position within wellbore 104. In some implementations, release tool 102 may be coupled to conveyance 116 (e.g., wireline such as slickline) through, for example, a rope socket or other coupling device. In some implementations, downhole tool string 103 may be deployed by release tool 102 into wellbore 104 via a lubricator (not shown) or simply dropped into wellbore 104. Release tool 102 may include release tool controller 120, which may enable release tool to communicate with control unit 118. Release tool controller 120 may further include control logic for executing commands received from control unit 118, such as commands to release downhole or decouple tool string 102 from release tool 102. Decoupling of release tool 102 from downhole tool string 103 may allow for easier retrieval of downhole tool string 103 from wellbore 104. For example, a top end of downhole tool string 103 may include a fishneck sub-assembly (not shown) that is coupled to release tool 102. Once released, the fishneck sub-assembly may be exposed for retrieval, e.g., with a fishing tool or other device.

In operation of downhole assembly 101, release tool 102 includes a release mechanism, which may be initiated by various actuation mechanisms. In some embodiments, the actuation mechanism is a mechanical mechanism controlled at surface 108, for example, using a tension release mechanism via conveyance 116. In other embodiments, the actuation mechanism is electronic such that a command may be sent from control unit 118 to release tool controller 120. The command may be transmitted using electrical, optical, or acoustical signals, which are sent over conveyance 116 or another medium. At surface 108 in proximity to well head 106, control unit 118 may be a system based on a microprocessor, a mechanical, or an electro mechanical controller. In certain embodiments, release tool 102 may be autonomous or semi-autonomous and may self-activate the release of the downhole tool 103 without receiving a direct command for a release event, for example, when a heartbeat signal from control unit 118 is not received before a specified timeout period elapses.

As will be described in further detail, release tool controller 120 communicates with control unit 118. In some embodiments, release tool controller 120 allows a user to initiate the release of the downhole tool, for example, by manually triggering a release command at control unit 118. The release command may be received by release tool controller 120, which then activates an actuator in release tool 102 for releasing or decoupling release tool 102 from downhole tool string 103. Release tool controller 120 may include a programmable timer, or programmable timer functionality, that the user may program at any time with a desired release time or release delay, according to which release tool controller 120 activates the actuator.

Additionally, release tool controller 120 may store a first logical identifier that is a unique value or address for each particular instance of release tool 102. The first logical identifier may be written to release tool controller 120 prior to insertion in wellbore 104. When multiple instances of release tool 102 are used in wellbore 104, each one of release tool 102 may store a unique value for the first logical identifier. When a release command is sent from control unit 118, the release command may include a second logical identifier. The second logical identifier may represent a target address for an instance of release tool 102 for which the release command is intended. When release tool controller 120 receives the release command, release tool controller 120 may determine whether the second logical identifier in the release command matches the first logical identifier stored with release tool controller 120. When the second logical identifier matches the first logical identifier, release tool controller 120 may execute the release command. When the second logical identifier does not match the first logical identifier, release tool controller may ignore the release command. In this manner, multiple instances of release tool 102 may be individually addressed and activated, as desired, allowing multiple instances of release tool 102 to be used with well system 100, and to be placed at any desired location within wellbore 104, for specific and secure release of respective downhole tool strings 103.

Figure 2:
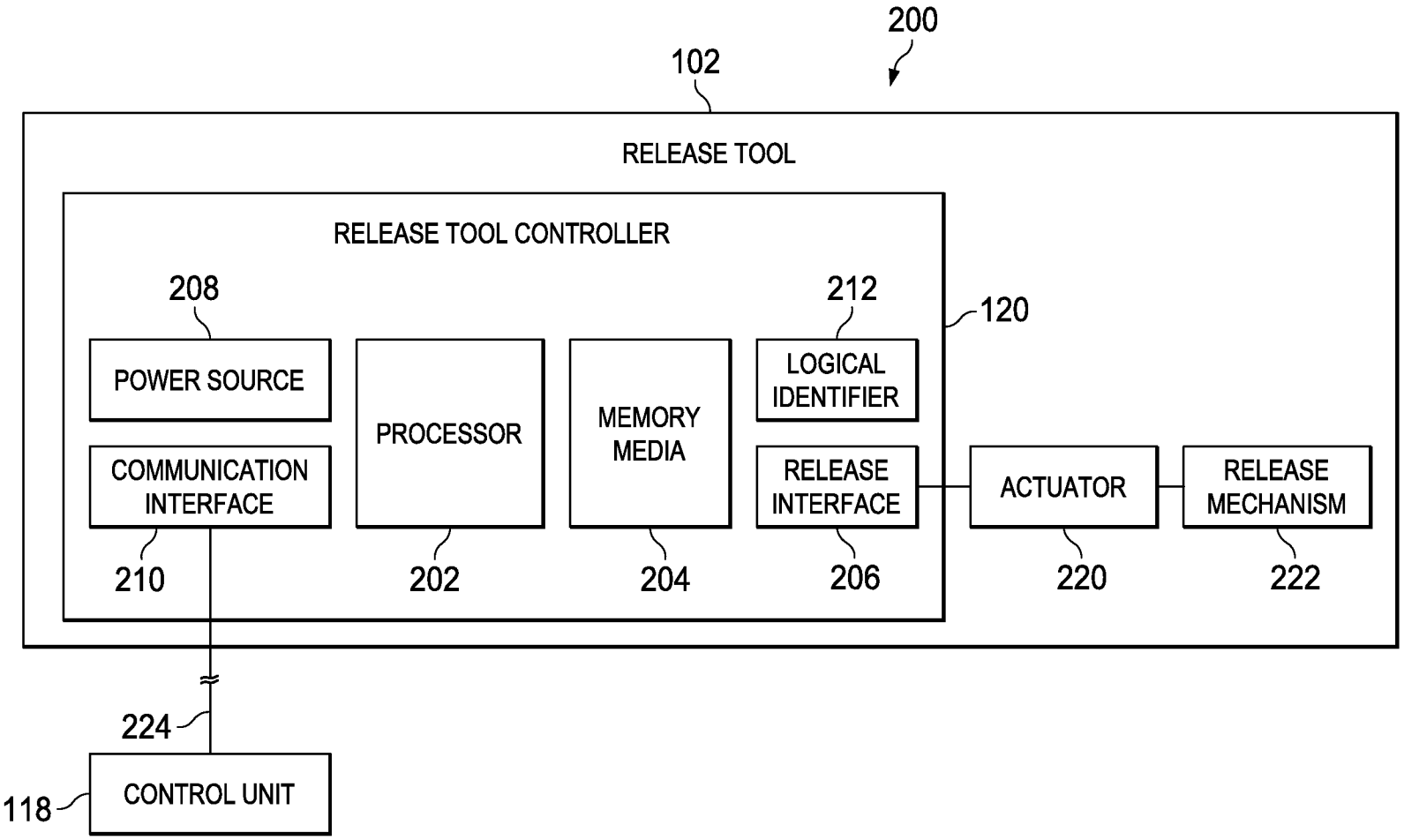
FIG. 2 is a block diagram of a release tool activation system for a flexible smart release tool, in accordance with some embodiments of the present disclosure.

Referring now to FIG. 2, selected elements of an embodiment of release tool activation system 200 are illustrated. As shown, release tool activation system 200 may represent selected portions of well system 100 to further illustrate release tool activation. Release tool activation system 200 includes release tool 102, including release tool controller 120, actuator 220, and release mechanism 222, which are located downhole and may be integrated within release tool 102. It is noted that release tool controller 120 may represent an electronic device that is packaged in a suitable manner for downhole use. Also shown is communication link 224 which enables communication between release tool 102 and control unit 118, which is located at the surface. In FIG. 2, release tool controller 120 is shown including processor 202, memory media 204, release interface 206, power supply 208, communication interface 210, and logical identifier 212. Release tool controller 120 may be used to perform the steps of methods 300 and 400 as described with respect to FIGS. 3 and 4.

Processor 202 may include, for example a microprocessor, microcontroller, digital signal processor (DSP), application specific integrated circuit (ASIC), or any other digital or analog circuitry configured to interpret and/or execute program instructions and/or process data. In some embodiments, processor 202 may be communicatively coupled to memory media 204. Processor 202 may execute program instructions stored in memory media 204. Program instructions or data may be executable for control of release interface 206, as described herein. Memory media 204 may include any system, device, or apparatus to receive one or more memory modules that store program instructions or data (e.g., computer-readable non-transitory media). For example, memory media 204 may include read-only memory, random access memory, solid state memory, or disk-based memory. Under control of processor 202 having access to memory media 204, which may store instructions executable by processor 202 to implement functionality described herein, release tool controller 120 accesses communication interface 210, logical identifier 212, and release interface 206. It is noted that processor 202 may include a real-time clock (not shown) to maintain a precise time base or absolute timestamp while release tool controller 200 operates downhole.

In FIG. 2, power source 208 represents a source of electrical power used to power various elements in release tool controller 200, including processor 202, memory media 204 and communication interface 210, among other elements. Communication interface 210 may represent any of a variety of interfaces that enable processor 202 to communicate using communication link 224. Thus, communication interface 210 may convert signals from processor 202 into a format that is transmittable over communication link 224. Communication link 224 may represent different media to communicate with control unit 118, which may be at ground level. In certain embodiments where line power is available, power source 208 may represent line power, while communication link 224 may be a wired communication link including galvanic media or optical media for wired connectivity up the borehole. Galvanic media for galvanic connectivity include copper wire, aluminum wire, or other metallic connections. Optical media for optical connectivity include optical fibers or other optical connections. When line power is not available or not desired, for example, power source 208 may represent a battery included with release tool controller 200. In various embodiments, communication link 224 may represent a wireless communication channel, such as an acoustic telemetry channel, or another suitable wireless interface for downhole communication with release tool controller 120 from control unit 118.

In FIG. 2, logical identifier 212 is an identifier or address having a value unique to a particular one of release tool controller 120. In other words, each instance of release tool controller 200 may include a different and unique value for logical identifier 212. In certain embodiments, logical identifier 212 may be stored as data in memory media 204. In some embodiments, logical identifier 212 represents a non-volatile memory storing the unique value that is different from memory media 204. Logical identifier 212 may also be provided in the form of standardized identification component, such as a radio-frequency identification tag (RFID), for example, that may be read electronically or wirelessly. The unique value for logical identifier 212 may be programmed or written to release tool controller 120 prior to insertion into the borehole. Logical identifier 212 may then serve as a logical or device address for communications, such as release commands, received from control unit 118. Specifically, logical identifier 212 may be a first logical identifier, while release commands received from control unit 118 may include, or specify, a second logical identifier that indicates an intended target for the particular release command. When release tool controller 120 receives a release command from control unit 118, release tool controller 120 may compare the first logical identifier (stored as logical identifier 212) with the second logical identifier specified in the release command. When the first logical identifier and the second logical identifier match, release tool controller 120 may execute the release command. When the first logical identifier and the second logical identifier do not match or are different, release tool controller 120 may ignore the release command. In this manner, multiple instances of release tool controller 200 may be safely and securely operated using a single instance of control unit 118 and communication link 224 within the borehole.

Release interface 206 may represent a device or electronic components for controlling actuation of a mechanical actuator that releases downhole tool string 103 from release tool 102. Release interface 206 may be coupled to actuator 220, which, in turn, is coupled to release mechanism 222. Actuator 220 may be selected from various types of actuation elements, including resistive, semiconductor, optical, magnetic, explosive, etc. In certain embodiments, release interface 206 may represent a switch that supplies power to actuator 220 when the switch is closed, thereby activating actuator 220. Thus, release tool controller 200 may close the switch represented by release interface 206 to activate actuator 220 and engage release mechanism 222, thereby decoupling release tool 102 from downhole tool string 103. Instructions executable by processor 202 stored in memory media 204 may include instructions to activate release interface 206, irrespective of the type of actuation element used by actuator 220. In some embodiments, actuator 220 is included with release interface 206. In some implementations, actuator 220 is integrated within release mechanism 222.

Additional functionality may be implemented by processor 202, including timer and delay operations. For example, the release command received from control unit 118 may specify a time value, such as a delay time or a timestamp in the future. When the release command specifies a delay time, processor 202 may wait until the delay time has elapsed to activate release interface 206. When the release command specifies a timestamp in the future, processor 202 may wait until the timestamp is reached to activate release interface 206.

Figure 3:
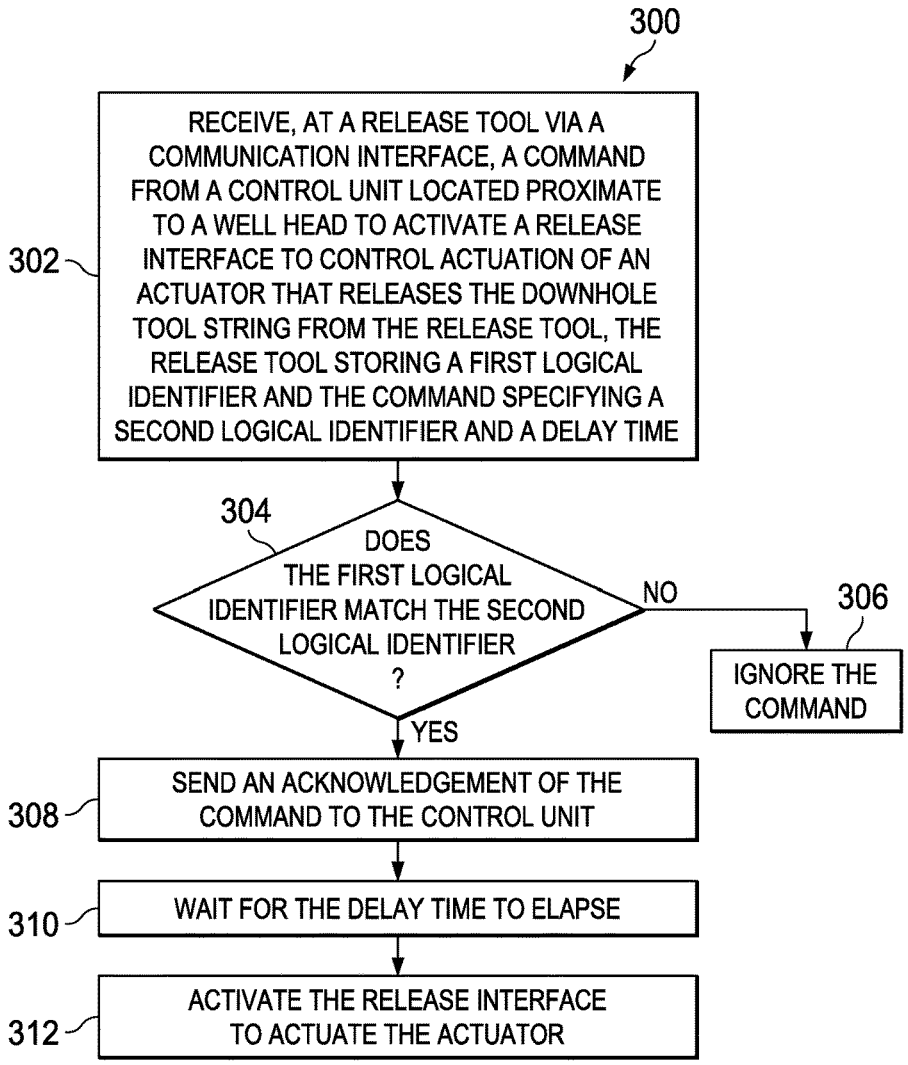
FIG. 3 is a flow chart illustrating a method for releasing a tool string by a smart release tool, in accordance with some embodiments of the present disclosure.

Referring now to FIG. 3, a flow chart of method 300 for releasing a tool string by a release tool within a subterranean well having a well head, as described herein, is illustrated. It is noted that certain operations described in method 300 may be optional or may be rearranged in different embodiments. Method 300 is described as being performed by release tool 102, and in particular, by release tool controller 120 (FIGS. 1 and 2), however, any other suitable system, apparatus, or device may be used. Although certain types of communication are described in method 300 for descriptive purposes, it will be understood that additional or other communication, messages, commands, etc. may be exchanged between release tool controller 120 and control unit 118 (FIGS. 1 and 2).

Method 300 begins at step 302 by receiving, at a release tool via a communication interface, a command from a control unit located proximate to a well head to activate a release interface to control actuation of an actuator that releases the downhole tool string from the release tool, the release tool storing a first logical identifier and the command specifying a second logical identifier and a delay time. Thus, step 302 may be performed while release tool 102 is within the wellbore and control unit 118 is at surface level. The command may omit the delay time in step 102, for example, when immediate release of the release tool is desired. The delay time in step 102 may be substituted with a timestamp in the future. Then at step 304 a determination is be made whether the first logical identifier matches the second logical identifier. When the first logical identifier does not match the second logical identifier, the command may be ignored at step 306. When the first logical identifier matches the second logical identifier, an acknowledgement of the command may be sent to the control unit at step 308. In certain embodiments, the acknowledgement in step 308 (or a second acknowledgement in addition to step 308) may be sent after step 310 or step 312. Then, the release interface is activated at step 312 to actuate the actuator.

Figure 4:
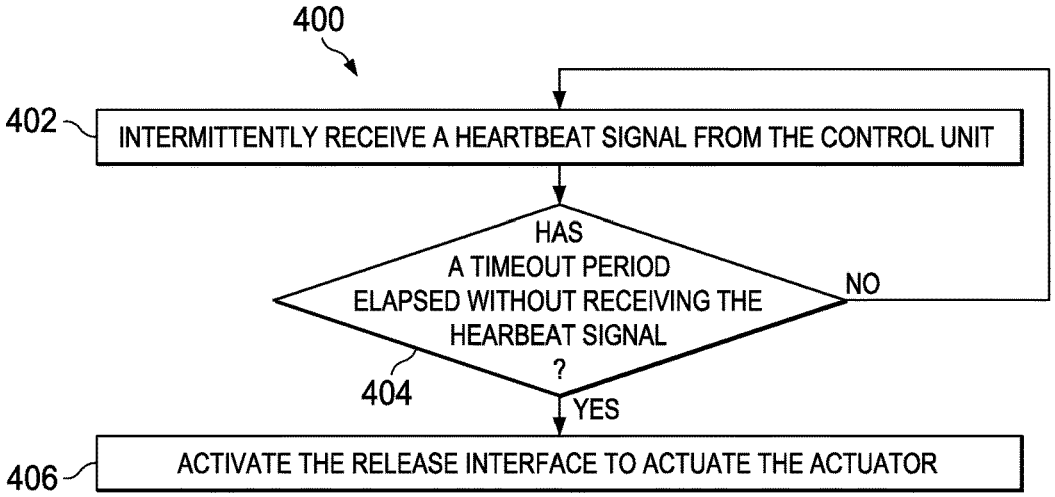
FIG. 4 is a flow chart illustrating a method for releasing a tool string by a smart release tool, in accordance with some embodiments of the present disclosure.

Referring now to FIG. 4, a flow chart of method 400 for releasing a tool string by a release tool within a subterranean well having a well head, as described herein, is illustrated. It is noted that certain operations described in method 400 may be optional or may be rearranged in different embodiments. Method 400 is described as being performed by release tool 102, and in particular, by release tool controller 120 (FIGS. 1 and 2), however, any other suitable system, apparatus, or device may be used. Although certain types of communication are described in method 400 for descriptive purposes, it will be understood that additional or other communication, messages, commands, etc. may be exchanged between release tool controller 120 and control unit 118 (FIGS. 1 and 2).

Method 400 at step 402 begins by intermittently receiving a heartbeat signal from the control unit. The heartbeat signal may be sent by control unit 118 to indicate that control unit 118 is operating responsively and that a communication channel between control unit 118 and release tool 102 is operating. At step 404, a determination is made whether a timeout period has elapsed without receiving the heartbeat signal. The timeout period may be a value included with release tool controller 120 prior to insertion in the borehole and may be set to be greater than an expected duration between receipt of individual heartbeat signals by release tool controller 120. When the timeout period has not elapsed, method 400 may loop back to step 402. When the timeout period has elapsed, the release interface may be activated at step 406 to actuate the actuator. As described above, a delay time may be used with step 406 prior to activation of the release interface.

As disclosed herein, a flexible smart release tool enables a control unit at the surface to individually communicate with release tools that are located downhole. The release tools may be individually addressed using a unique logical identifier. Thus, a specific release tool may be sent a command to release an attached downhole tool string at any time. The release tool may include control logic for receiving the command and using an onboard clock for timing of activation of a release interface, as specified in the command. A heartbeat function may be implemented between the release tool and the control unit.

In a first aspect, a disclosed release tool is for releasing a tool string within a subterranean well having a well head. The release tool may include a release interface to control actuation of an actuator that releases the tool string from the release tool, and a communication interface to communicate with a control unit located proximate to a well head. The release tool further includes a first logical identifier uniquely associated with the release tool, memory media, and a processor having access to the memory media. The memory media may store instructions executable by the processor to receive, via the communication interface, a command from the control unit to activate the release interface. The command may specify a second logical identifier. The instructions may be to determine whether the first logical identifier matches the second logical identifier. When the second logical identifier matches the first logical identifier, the instructions may be to activate the release interface to actuate the actuator.

In a second aspect, a method is disclosed for releasing a tool string by a release tool within a subterranean well having a well head. The method may include receiving, at a release tool via a communication interface, a command from a control unit located proximate to the well head to activate a release interface to control actuation of an actuator that releases the tool string from the release tool. The method may include determining whether the first logical identifier matches the second logical identifier. When the first logical identifier matches the second logical identifier, the method may include activating the release interface to actuate the actuator.

In a third aspect, a disclosed system includes a tool string for insertion into a subterranean well having a well head, and a release tool releasably coupled to the tool string for releasing the tool string within the subterranean well. The release tool may include a release interface to control actuation of a mechanical actuator that releases the tool string from the release tool, and a communication interface to communicate with a control unit, including to receive commands from the control unit. The control unit may be located proximate to the well head. The release tool may include a first logical identifier uniquely associated with the release tool, memory media, and a processor having access to the memory media. The memory media may store instructions executable by the processor to receive, via the communication interface, a command from the control unit to activate the release interface. The command may specify a second logical identifier. The instructions may be to determine whether the first logical identifier matches the second logical identifier. When the first logical identifier matches the second logical identifier, the instructions may be to activate the release interface to actuate the mechanical actuator.

In any embodiment of each of the disclosed aspects, a communication interface may communicate with the control unit using at least one of: galvanic media, optical media, and acoustic telemetry. The memory media may further include instructions to send an acknowledgement of the command to the control unit. The command may specify a delay time, while the instructions to activate the release interface are executed after the delay time has elapsed. The command may specify a timestamp in the future, while the instructions to activate the release interface are executed when the timestamp is reached.

In any embodiment of each of the disclosed aspects, when the second logical identifier is different from the first logical identifier, the memory media may further comprise instructions to ignore the command. The release tool may further include a non-volatile memory different from the memory media. The non-volatile memory may store the first logical identifier. The release tool may further include a power source to supply power to at least the processor, the memory media, and the communication interface. The memory media may further include instructions to intermittently receive a heartbeat signal from the control unit. When the heartbeat signal is not received after a timeout period elapses, the instructions may be to activate the release interface to actuate the actuator.

In any embodiment of each of the disclosed aspects, a disclosed method may include sending an acknowledgement of the command to the control unit. When the second logical identifier is different from the first logical identifier, the method may include ignoring the command. The disclosed method may include intermittently receiving a heartbeat signal from the control unit. When the heartbeat signal is not received after a timeout period elapses, the disclosed method may include activating the release interface to actuate the mechanical actuator.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Further-more, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein or in the absence of any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each item of the list. The phrase "at least one of" allows a meaning that includes at least one of any one of the items, at least one of any combination of the items, and at least one of each of the items. By way of example, the phrases "at least one of A, B, and C" or "at least one of A, B, or C" may each refer to only A, only B, or only C; any combination of A, B, and C; or at least one of each of A, B, and C.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A release tool for releasing a tool string comprising:

a release interface to control actuation of an actuator that releases a downhole tool string from the release tool;

a communication interface to communicate with a control unit located proximate to a well head;

a first logical identifier uniquely associated with the release tool;

memory media; and a processor having access to the memory media, wherein the memory media stores instructions executable by the processor to:

receive, via the communication interface, a command from the control unit located proximate to the well head to activate the release interface, the command specifying a second logical identifier and a timestamp specifying a release time in the future, wherein the release time is user programmable at any time via the control unit located proximate to the well head;

determine whether the first logical identifier matches the second logical identifier; and activate the release interface to actuate the actuator when the second logical identifier matches the first logical identifier and the release time specified by the timestamp is reached.

2. The release tool of claim 1, wherein the memory media further comprise instructions to:

when the second logical identifier is different from the first logical identifier, ignore the command.

3. The release tool of claim 1, further comprising:

a non-volatile memory different from the memory media, wherein the non-volatile memory stores the first logical identifier.

4. The release tool of claim 1, further comprising:

a power source to supply power to at least the processor, the memory media, and the communication interface.

5. The release tool of claim 1, wherein the memory media further stores instructions executable by the processor to send an acknowledgement of the command to the control unit located proximate to the well head.

6. The release tool of claim 1, wherein the memory media further stores instructions executable by the processor to:

intermittently receive a heartbeat signal from the control unit, the heartbeat signal sent intermittently from the control unit to indicate an operating communication channel between the control unit and the release tool;

determine an elapsed time since receiving the heartbeat signal;

compare the elapsed time to a timeout period, the timeout period set to a value greater than an expected duration between intermittently receiving the heartbeat signal; and activate the release interface to actuate the actuator when the elapsed time reaches the timeout period.

7. A method for releasing a downhole tool string, the method comprising:

receiving, at a release tool via a communication interface, a command from a control unit located proximate to a well head to activate a release interface to control actuation of an actuator that releases the downhole tool string from the release tool, wherein the release tool stores a first logical identifier and the command specifies a second logical identifier and a timestamp specifying a release time in the future, wherein the release time is user programmable at any time via the control unit located proximate to the well head;

determining whether the first logical identifier matches the second logical identifier; and activating the release interface to actuate the actuator when the second logical identifier matches the first logical identifier and the release time specified by the timestamp is reached.

8. The method of claim 7, further comprising:

when the second logical identifier is different from the first logical identifier, ignoring the command.

9. The method of claim 7, further comprising sending an acknowledgement of the command to the control unit located proximate to the well head.

10. The method of claim 7, further comprising:

intermittently receiving a heartbeat signal from the control unit, the heartbeat signal sent intermittently from the control unit to indicate an operating communication channel between the control unit and the release tool;

determining an elapsed time since receiving the heartbeat signal;

comparing the elapsed time to a timeout period, the timeout period set to a value greater than an expected duration between intermittently receiving the heartbeat signal; and activating the release interface to actuate the actuator when the elapsed time reaches the timeout period.

11. A system comprising:

a downhole tool string for insertion into a subterranean well having a well head; and a release tool releasably coupled to the downhole tool string, the release tool comprising:

a release interface to control actuation of an actuator that releases the downhole tool string from the release tool;

a communication interface to communicate with a control unit located proximate to the well head;

a first logical identifier uniquely associated with the release tool;

memory media; and a processor having access to the memory media, wherein the memory media store instructions executable by the processor to:

receive, via the communication interface, a command from the control unit located proximate to the well head to activate the release interface, the command specifying a second logical identifier and a timestamp specifying a release time in the future, wherein the release time is user programmable at any time via the control unit located proximate to the well head;

determine whether the first logical identifier matches the second logical identifier; and activate the release interface to actuate the actuator when the second logical identifier matches the first logical identifier and the release time specified by the timestamp is reached.

12. The system of claim 11, wherein the memory media further comprise instructions to:

when the second logical identifier is different from the first logical identifier, ignore the command.

13. The system of claim 11, wherein the release tool further comprises:

a non-volatile memory different from the memory media, wherein the first logical identifier is stored in the non-volatile memory.

14. The system of claim 11, further comprising:

a power source to supply power to at least the processor, the memory media, and the communication interface.

15. The system of claim 11, wherein the memory media further stores instructions executable by the processor to send an acknowledgement of the command to the control unit located proximate to the well head.

16. The system of claim 11, wherein the memory media further stores instructions executable by the processor to:

intermittently receive a heartbeat signal from the control unit, the heartbeat signal sent intermittently from the control unit to indicate an operating communication channel between the control unit and the release tool;

determine an elapsed time since receiving the heartbeat signal;

compare the elapsed time to a timeout period, the timeout period set to a value greater than an expected duration between intermittently receiving the heartbeat signal; and activate the release interface to actuate the actuator when the elapsed time reaches the timeout period.

* * * * *